US007726137B2

(12) United States Patent
Bakker et al.

(10) Patent No.: US 7,726,137 B2
(45) Date of Patent: Jun. 1, 2010

(54) METHOD AND APPARATUS FOR REFRIGERANT RECOVERY UNIT FILTER DRYER MAINTENANCE

(75) Inventors: Travis Bakker, Mantorville, MN (US); Gary Murray, Montpelier, OH (US)

(73) Assignee: SPX Corporation, Charlotte, NC (US)

( * ) Notice: Subject to any disclaimer, the term of this patent is extended or adjusted under 35 U.S.C. 154(b) by 850 days.

(21) Appl. No.: 11/477,585

(22) Filed: Jun. 30, 2006

(65) Prior Publication Data

US 2008/0000240 A1 Jan. 3, 2008

(51) Int. Cl.
*F25B 45/00* (2006.01)

(52) U.S. Cl. ..... 62/77; 62/92; 62/475

(58) Field of Classification Search ..... 62/77, 62/149, 292, 475, 92
See application file for complete search history.

(56) References Cited

U.S. PATENT DOCUMENTS 3,400,552 A * 9/1968 Johnson et al. ..... 62/149
4,768,347 A * 9/1988 Manz et al. ..... 62/149
5,095,713 A * 3/1992 Laukhuf et al. ..... 62/149
5,193,351 A * 3/1993 Laukhuf et al. ..... 62/77
5,517,825 A * 5/1996 Manz et al. ..... 62/158
5,603,223 A * 2/1997 Murray et al. ..... 62/84
5,758,506 A * 6/1998 Hancock et al. ..... 62/77
5,934,091 A * 8/1999 Hanson et al. ..... 62/149

* cited by examiner

*Primary Examiner*—Melvin Jones
(74) *Attorney, Agent, or Firm*—Baker & Hostetler LLP

(57) ABSTRACT

A method and apparatus for ensuring a user to change a filter dryer of a refrigerant recovery unit having a refrigerant determining module that is configured to determine a condition of the refrigerant or an amount of refrigerant that has passed through the filter dryer, or a condition of the filter dryer, an alert device that notifies the user to change the filter dryer in response to the condition, a pressure module that regulates the pressure in the filter dryer, and a pressure-sensing device that is configured to detect a change of pressure in response to filter dryer maintenance. The refrigerant recovery unit is disabled from recovering refrigerant when the refrigerant determining module determines that the filter dryer needs to be replaced, and it is activated in response to the change of pressure detected by the pressure-sensing device.

20 Claims, 2 Drawing Sheets

METHOD AND APPARATUS FOR REFRIGERANT RECOVERY UNIT FILTER DRYER MAINTENANCE

FIELD OF THE INVENTION

The present invention relates generally to refrigerant recovery units maintenance. More particularly, the present invention relates to filter dryer maintenance for refrigerant recovery units.

BACKGROUND OF THE INVENTION

Filter dryers in refrigerant recovery units are used to trap acid, moisture, or particulates as the refrigerant passes through the filter dryers. These filter dryers, typically, have a maximum capacity to trap these contaminants. In order for the refrigerant recovery unit to function properly, these filter dryers need to be replaced periodically to ensure the refrigerant is cleaned upon the recovery/recycle process. Otherwise, continued use of the saturated filter dryers can be damaging to the air conditioning system.

Currently, a user is prompted to change the filter dryer when a predetermined amount of refrigerant has passed through the filter dryer, such as one-hundred and fifty pounds. However, the user may simply ignore the notification by pushing a button indicating that he has changed the filter dryer and continues to use the expired filter dryer for the recovery/recycle process. Furthermore, the counter will reset to zero and the notification will not be activated until another one-hundred and fifty pounds of refrigerant has passed through the filter dryer. Thus, the refrigerant passing through the filter dryer will not be cleaned properly upon the recovery/recycle process.

Accordingly, it is desirable to provide a method and apparatus to ensure that a user performs filter dryer maintenance for a refrigerant recovery unit when the filter dryer needs to be replaced.

SUMMARY OF THE INVENTION

The foregoing needs are met, to a great extent, by the present invention, wherein in one aspect an apparatus is provided that in some embodiments a filter dryer maintenance is performed for a refrigerant recovery unit when a certain amount of refrigerant has passed through the filter dryer, thereby the refrigerant recovery unit can be performed at its optimal condition at all times.

In accordance with one embodiment of the present invention is a method for a user to change a filter dryer of a refrigerant recovery unit which can determine whether the filter dryer needs to be replaced, such as by determining an amount of refrigerant that has passed through the filter, or determining a condition of the filter dryer, such as if the filter dryer is saturated, or determining the condition of the refrigerant that has passed through the filter dryer. The method can generate an alert to change the filter dryer in response to the determination that a filter dryer needs to be replaced, for example if a predetermined amount of refrigerant is set, i.e. at 150 pounds. The method can disable the refrigerant recovery unit, such that the refrigerant recovery unit is unable to further recover/recycle the refrigerant. The method can further prepare the filter dryer to be removed, wherein the filter dryer is ready to be removed when pressure in the filter dryer reaches a first predetermined vacuum level, wherein the first predetermined vacuum level is greater than 5 inches of Mercury (Hg). The method can further determine whether the filter dryer has been removed within a preset time, can generate the alert again if the filter dryer is not replaced within the preset time, wherein the preset time is between 3-7 minutes. The method can further determine a second vacuum level during the preset time, and can allow the user to continue if the second vacuum level is less than a second predetermined vacuum level, wherein the second predetermined vacuum level is less than the first predetermined vacuum level, wherein the second predetermined vacuum level is less than or equal to 1 inch of Hg. The method can further install a second filter dryer, and prepare the second filter dryer to be used by removing air with a compressor, such that the pressure reaches a third predetermined vacuum level, wherein the third predetermined vacuum level is greater than 13 inches of Hg. The method can further reset a filter dryer counter to zero upon disconnecting the old filter dryer or confirming that the new filter dryer has been replaced, and can activate the refrigerant recovery unit to recover/recycle the refrigerant.

In accordance with another embodiment of the present invention is an apparatus for a user to change a filter dryer of a refrigerant recovery unit which comprises a refrigerant determining module that is configured to determine if the filter dryer needs to be replaced, an alert device that can notify the user to change the filter dryer in response to a determination that the filter dryer needs to be replaced, wherein the alert device can display warnings or reminders in response to the amount of refrigerant passing through the filter dryer, a pressure module that can regulate the pressure of the refrigerant recovery unit, wherein the pressure module removes refrigerant from the filter dryer, and a pressure sensing device that is configured to detect a change of pressure in response to the filter dryer being disconnected from the system, wherein the pressure sensing device enables the refrigerant recovery unit after the filter dryer maintenance. The refrigerant recovery unit is disabled from recovering refrigerant when the refrigerant determining module determines to replace the filter dryer. The filter dryer is determined to be replaced in response to the filter dryer being saturated, or a predetermined amount of refrigerant has passed through the filter dryer, or when the refrigerant is not being cleaned properly. The refrigerant recovery unit is activated in response to the change of pressure detected by the pressure-sensing device or a confirmation that a new filter dryer has been installed.

In accordance with yet another embodiment of the present invention is a system for a user to change a filter dryer of a refrigerant recovery unit which comprises a means which can determine if the filter dryer needs to be replaced, means which can generate an alert to change the filter dryer in response to a determination that the filter dryer needs to be replaced; means which can deactivate the refrigerant recovery unit; means which can prepare the filter dryer to be removed; means which can determine whether the filter dryer has been removed within a preset time, wherein the preset time is between 3-7 minutes; and means which can activate the refrigerant recovery machine in response to a confirmation that a second filter dryer being inserted. The system further comprises a means which can generate an alert to change the filter dryer if the filter dryer is not replaced within the preset time, means which can determine a vacuum level during the preset time, wherein the vacuum level is less than or equal to 1 inch of Mercury vacuum, means which can allow the user to continue if the vacuum level is less than a predetermined vacuum level, and means which can prepare the second filter dryer to be used.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

An embodiment in accordance with the present invention provides an apparatus and method for a user to perform filter dryer maintenance of a refrigerant recovery unit when a filter dryer needs to be replaced. When the unit determines that the filter dryer needs to be replaced, the unit will be disabled from recovering/recycling more refrigerant. Upon being disabled, the unit would prompt the user through a filter dryer change procedure, which would remove refrigerant and create a vacuum in the filter dryer before it is disconnected from the unit. The vacuum in the filter dryer can be monitored by pressure sensing devices such as a pressure switch or transducer. When the user disconnects the filter dryer from the unit to replace it with another filter dryer, the pressure-sensing device would sense a pressure change, which would be a signal to reactivate the refrigerant recovery unit.

This patent will compare different vacuum levels using the terms "greater than" and "less than." A "greater vacuum level" is intended to have the same meaning as "lesser absolute pressure." Conversely, a "lesser vacuum level" has the same meaning as "greater absolute pressure." All references to pressure use inch of Mercury (Hg) as the unit.

Figure 1:
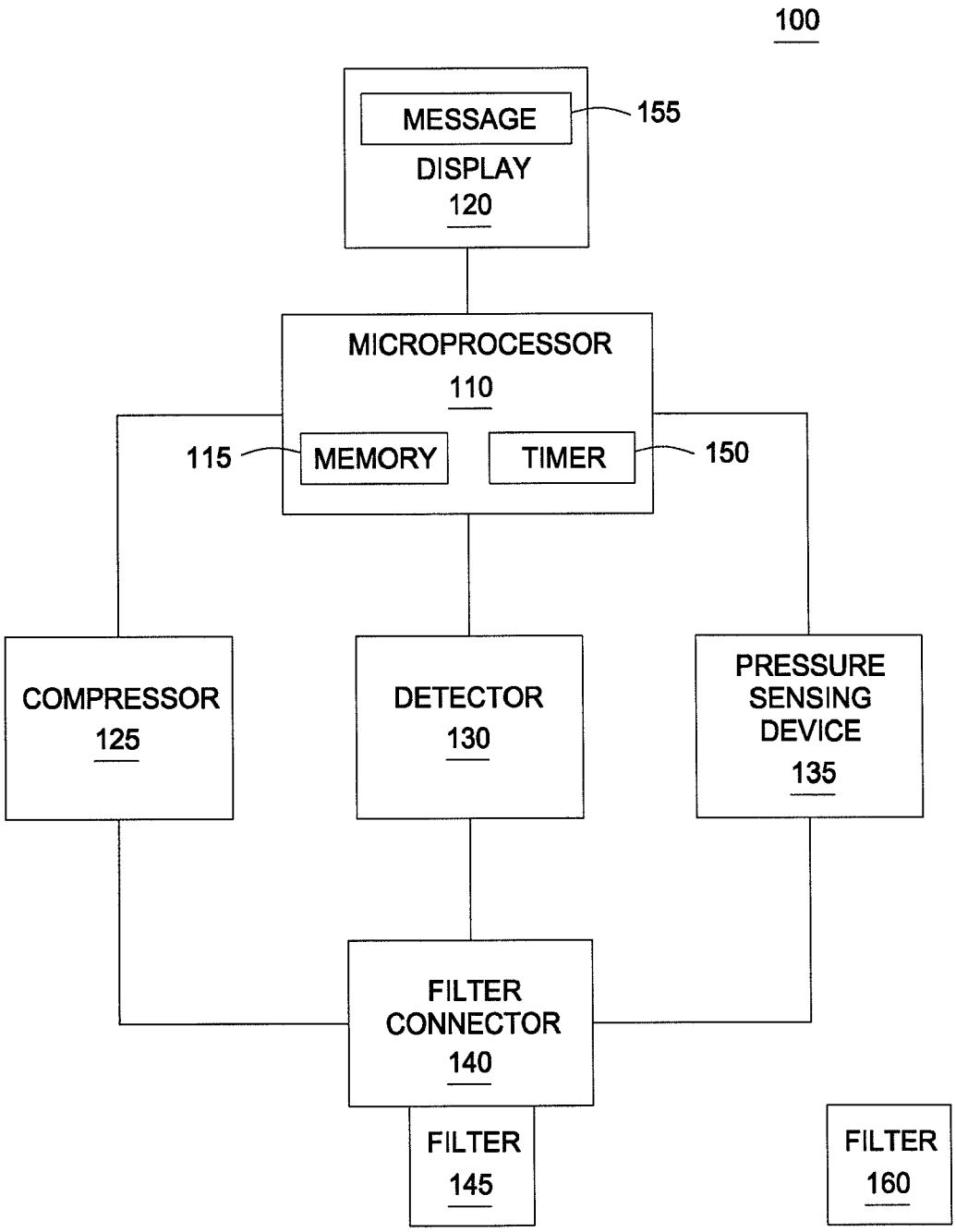
FIG. 1 illustrates a block diagram of a refrigerant recovery unit according to an embodiment of the invention.

The invention will now be described with reference to the drawing figures, in which like reference numerals refer to like parts throughout. FIG. 1 illustrates a block diagram of a refrigerant recovery unit 100 according to an embodiment of the invention. A microprocessor 110 having, at least, an internal memory 115 and a timer 150. The microprocessor 110 is connected to a display 120, a compressor 125, a detector 130, and a pressure-sensing device 135. The compressor 125, the detector 130, and the pressure-sensing device 135 are further connected to a filter dryer connector 140. The pressure sensing device 135 can be a pressure switch, a pressure transducer, or other pressure sensing module.

The filter dryer connector 140 is connected directly to a filter dryer 145. The filter dryer 145 is used to trap acid, moisture, and particulates in the refrigerant. The detector 130 can determine the filter dryer 145 needs to be replaced. For example, the detector 130 can measure the amount of refrigerant that has passed through the filter dryer, or measure the weight of the filter dryer with the trapped contaminants, or determine whether the filter dryer is saturated, or determine the condition of the refrigerant that has passed through the filter dryer, or determine through other means and methods, whether the filter dryer 145 needs to be changed.

The detector 130 can send a signal to the microprocessor 110, which then can display messages 155 on the display 120. These can be messages that display the relative qualification of the remaining life of the filter dryer 145, the current amount of refrigerant that the filter dryer has processed, reminders for the user to purchase a replacement filter dryer, warnings that filter dryer maintenance is approaching, or other messages. The display 120 can be a touch-screen display, which can serve as an input of the unit 100 and is in communication with the microprocessor 110. In the alternative, the unit 100 can have separate input devices connecting to the microprocessor 110. The abovementioned components are some of the main components that relate to the present invention. Other components of the refrigerant recovery units are known in the art.

In this embodiment, when the microprocessor 110, through the detector 130, determines that the filter dryer 145 needs to be replaced. One condition for the filter dryer 145 to be replace is if a predetermined amount of refrigerant has passed through the filter dryer 145, for example one-hundred and fifty pounds. Other conditions can also be used to determine when the filter dryer 145 needs to be replaced, such as the saturation of the filter dryer or the condition of the refrigerant after passing through the recycling process. Once determined that the filter dryer needs to be replaced, the microprocessor 110 will notify the user of mandatory filter dryer maintenance and will disable the unit 100 by displaying a message 155 on the display 120. The compressor 125 will remove refrigerant and air, thereby creating a vacuum on the filter dryer 145, until the pressure sensing device 135 detects that the vacuum level is greater than five inches of Mercury (Hg). At this point, the timer 150 will begin and the user can change the filter dryer 145 within a preset time, for example 5 minutes. The unit 100 can also have other desired preset times, such as between 3-7 minutes.

If the user disconnects the filter dryer 145 during the preset time, the pressure-sensing device 135 will sense the change of pressure (i.e. the absolute pressure rises to above one inch of Hg vacuum or the vacuum level decreases to less than one inch of Hg) and that will be a signal for the microprocessor 110 to activate the unit 100. If the user does not change the filter dryer 145 or if the pressure-sensing device 135 does not detect a rise in pressure within the preset time, the microprocessor 110 will signal the display 120 to display a mandatory filter dryer maintenance notice, and the process will continue until the user changes the filter dryer 145.

Upon changing the filter dryer 145, the compressor 125 will prepare a second filter dryer 160 by removing air from the second filter dryer 160 until the pressure sensing device 135 senses the vacuum level is greater than 13 inches of Hg. In addition, the detector 130 will reset to zero and the unit 10 is ready to recover/recycle refrigerant.

If the detector 130 detects that the predetermined amount of refrigerant has passed through the filter dryer 145 in the middle of a recovery/recycle cycle, the unit 100 will allow the user to finish the cycle before prompting the user to change the filter dryer. However, upon the end of this cycle, the microprocessor 110 will disable the unit 100 and force the user to change the expired filter dryer 145.

Furthermore, the microprocessor 110 can also signal the display 120 to display warning messages 155 regarding filter dryer maintenance when twenty-five pounds, or any other desired increment, of refrigerant has passed through the filter dryer 145. Therefore, the user will be notified well before the filter dryer 145 reaches the mandatory replacement weight. Hence, the user will not be surprised when the unit 100 is disabled due to the mandatory maintenance.

Figure 2:
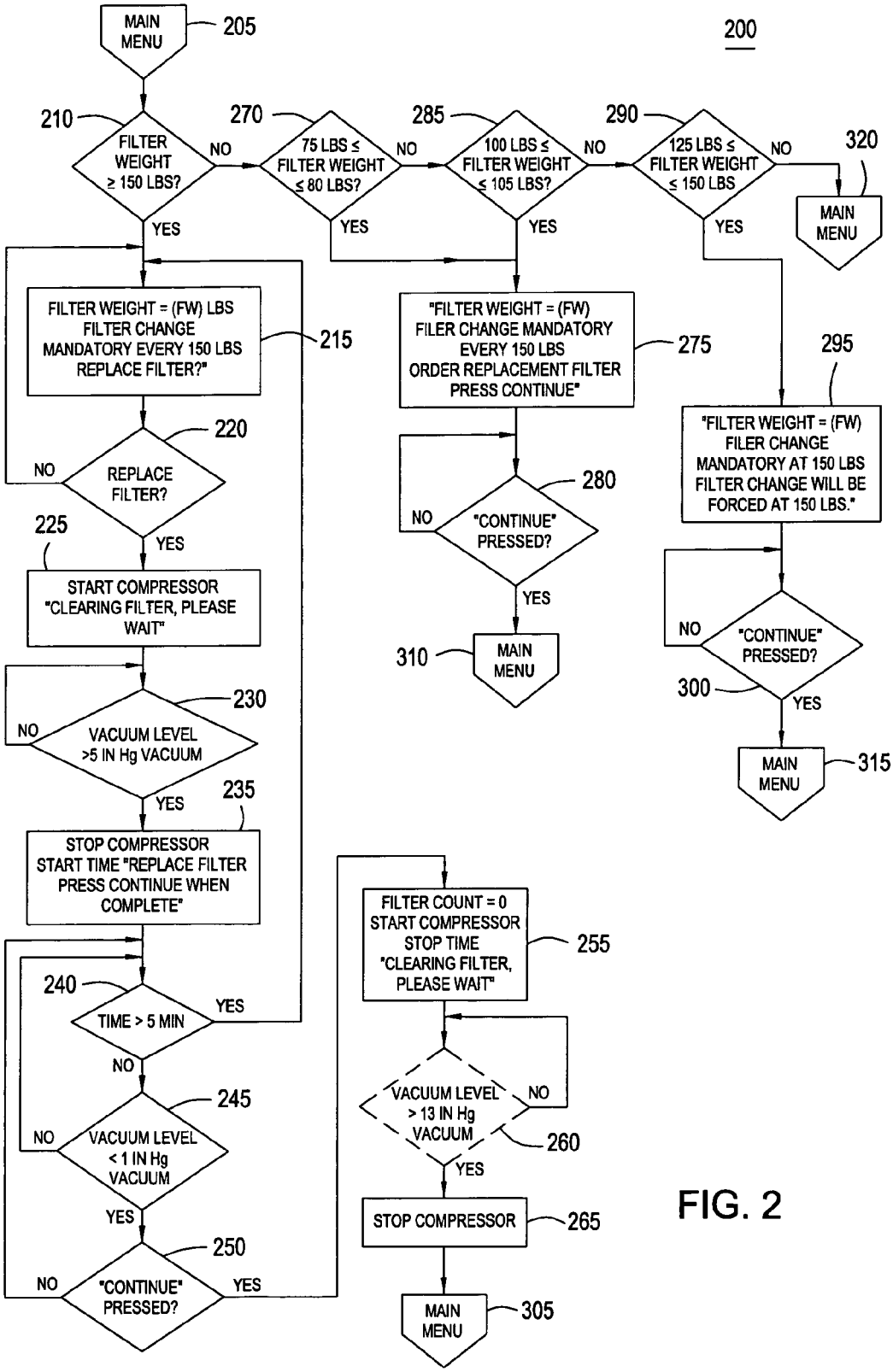
FIG. 2 is a flow chart depicting a manner in which the refrigerant recovery unit illustrated in FIG. 1 may be practiced.

FIG. 2 is a flow chart 200 depicting a manner in which the refrigerant recovery unit 100 illustrated in FIG. 1 may be practiced. The process begins at step 205 where the display 120 displays a main menu. Next, in step 210, the detector 130 detects the amount of refrigerant (by weight) that has passed through the filter dryer 145. If the amount is over one-hundred and fifty pounds, or another amount determined by the user or the manufacturer, the process continues to step 215. At this point, the unit 100 is disabled from recovering/recycling additional refrigerant.

In step 215, the filter weight is displayed on the display 120 and the user is prompted to change the filter dryer 145. Next, in step 220, the display 120 displays a message 155 giving the user an option to change the filter dryer 145. If the user decides to change the filter dryer 145, the process continues to step 225. If the user decides to not change the filter dryer 145, the process returns to step 215. At this point, the unit 100 remains locked until the user changes the filter dryer 145.

In step 225, the compressor 125 clears refrigerant from the filter dryer 145, thereby creating a vacuum in the filter dryer 145. Next, in step 230, the pressure-sensing device 135 detects the vacuum level in the filter dryer 145, the compressor 125 continues to operate until the vacuum level is greater than five inches of Hg. This process continues to step 235.

In step 235, the compressor 125 stops, the timer 150 starts and a message 155 is displayed telling the user to replace the filter dryer 145. Next, in step 240, the user has five minutes, or another predetermined time set by the user or manufacturer, to replace the filter dryer 145. If the user does not change the filter dryer 145 within five minutes, or the allotted time, the process returns to step 215. Next, in step 245, the pressure sensing device 135 detects the vacuum level in the filter dryer 145, if the vacuum level is greater than one inch of Hg, the process returns to step 240. If the vacuum level is less than one inch of Hg, the process continues to step 250. At this point, the unit 100 is reactivated to recover/recycle refrigerant.

In step 250, the user is prompted to press a button to confirm that a new filter dryer has been installed. If the user does not push the button, the process returns to step 240 and if the user pushes the button, the process continues to step 255. The button communicates to the microprocessor 110 that the process may continue.

In step 255, the detector 130 is reset to zero, the compressor 125 prepares the second filter dryer 160 by removing air from the second filter dryer 160. Next, in step 260, the compressor 125 continues to remove air until the pressure-sensing device 135 detects that the vacuum level is greater than thirteen inches of Hg. The process continues to step 265.

In step 265, the compressor 124 stops. Next, in step 305, the display 120 returns to the main menu.

Returning to step 210, if the detector 130 detects that the amount of refrigerant is less than one-hundred and fifty pounds, the process continues to step 270. In step 270, if the filter dryer weight is between seventy-five and eighty pounds, the process continues to step 275.

In step 275, the display 120 displays the amount of refrigerant that has passed through the filter dryer 145 and displays a message reminding the user to order a replacement filter dryer 145. Next, in step 280, the user is prompted to press a button. If the user does not push the button, the process remains at step 280. If the user presses the button, then next, in step 310, the display 120 returns to the main menu.

Returning to step 270, if the detector 130 detects that the amount of refrigerant is not between seventy-five and eighty pounds, the process continues to step 285. In step 285, if the filter dryer weight is between one-hundred and one-hundred and five pounds, the process continues to step 275 as stated above.

Returning to step 285, if the detector 130 detects that the amount of refrigerant is not between one-hundred and one-hundred and five pounds, the process continues to step 290. In step 290, if the detector 130 detects that the amount of refrigerant is between one-hundred and twenty-five pounds and one hundred and fifty pounds, the process continues to step 295. In step 295, the display 120 displays the amount of refrigerant that has passed through the filer dryer 145 and displays a message 155 warning the user about the mandatory filter dryer change at one-hundred and fifty pounds. Next, in step 300, the user is prompted to press a button. If the user does not push the button, the process remains at step 300. Upon pushing the button, in step 315, the display 120 returns to the main menu.

Returning to step 290, if the detector 130 detects that the amount of refrigerant is not between one hundred and twenty-five and one-hundred and fifty pounds, the process continues to step 320. In step 320, the display 120 returns to the main menu.

The filter dryer weights in the above embodiment are used as an example to demonstrate the warning capability of the system prior to the mandatory filter dryer change. These filter dryer weights are not meant to be limiting and can be modified based on the user's preference.

The various pressure and time in the above embodiment are used as an example to demonstrate the capability of the system to ensure the user to proceed with the mandatory filter dryer change. These pressure and time are not meant to be limiting and can be modified based on the user's preference. Although this specification discloses the use of negative pressure to detect pressure changes, the disclosed invention can also be practiced using positive pressure.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A method for a user to change a filter dryer of a refrigerant recovery unit, comprising:

determining whether to replace the filter dryer;

generating an alert to change the filter dryer in response to determining to replace the filter dryer;

preparing the filter dryer to be removed, wherein the filter dryer is ready to be removed when pressure in the filter dryer reaches a first predetermined vacuum level; and disabling the refrigerant recovery unit in response to determining whether to replace the filter dryer.

2. The method of claim 1, further comprising:

determining whether the filter dryer has been removed within a preset time.

3. The method of claim 2, further comprising:

generating the alert again if the filter dryer is not removed within the preset time.

4. The method of claim 3, further comprising:

determining a second vacuum level during the preset time; and allowing the user to continue if the second vacuum level is less than a second predetermined vacuum level.

5. The method of claim 4, wherein the second predetermined vacuum level is less than the first predetermined vacuum level.

6. The method of claim 4, further comprising:

installing a second filter dryer; and preparing the second filter dryer to be used by removing air with a vacuum source.

7. The method of claim 1, further comprising:

resetting a filter dryer counter to zero upon installing a new filter dryer; and enabling the refrigerant recovery unit to recover/recycle the refrigerant.

8. A method for a user to change a filter dryer of a refrigerant recovery unit, comprising:

determining whether to replace the filter dryer;

generating an alert to change the filter dryer in response to determining to replace the filter dryer; and disabling the refrigerant recovery unit in response to determining whether to replace the filter dryer, wherein the filter dryer is determined to be replaced in response to the filter dryer being saturated.

9. The method of claim 1, wherein the filter dryer is determined to be replaced in response to a predetermined amount of refrigerant that has passed through the filter dryer.

10. The method of claim 1, wherein the filter dryer is determined to be replaced in response to refrigerant not being cleaned properly.

11. An apparatus for a user to change a filter dryer of a refrigerant recovery unit, comprising:

a refrigerant determining module that is configured to determine whether to replace the filter dryer;

an alert device that notifies the user to change the filter dryer in response to a determination to replace the filter dryer;

a pressure module that regulates a pressure of the refrigerant recovery unit; and a pressure-sensing device that is configured to detect a change of pressure in response to determining to replace the filter dryer, wherein the filter dryer is determined to be replaced in response to the filter dryer being saturated.

12. The apparatus of claim 11, wherein the refrigerant recovery unit is disabled from recovering refrigerant when the refrigerant determining module determines to replace the filter dryer.

13. An apparatus for a user to change a filter dryer of a refrigerant recovery unit, comprising:

a refrigerant determining module that is configured to determine whether to replace the filter dryer;

an alert device that notifies the user to change the filter dryer in response to a determination to replace the filter dryer;

a pressure module that regulates a pressure of the refrigerant recovery unit; and a pressure-sensing device that is configured to detect a change of pressure in response to determining to replace the filter dryer, wherein the filter dryer is determined to be replaced in response to a predetermined amount of refrigerant that has passed through the filter dryer.

14. The apparatus of claim 12, wherein the filter dryer is determined to be replaced in response to refrigerant not being cleaned properly.

15. The apparatus of claim 11, wherein the refrigerant recovery unit is activated in response to the change of pressure detected by the pressure-sensing device.

16. The apparatus of claim 11, wherein the alert device can display warnings or reminders in response to an amount of refrigerant passing through the filter dryer or a degree of saturation of the filter dryer.

17. The apparatus of claim 11, wherein the pressure module removes refrigerant from the filter dryer.

18. The apparatus of claim 11, wherein the pressure-sensing device enables the refrigerant recovery unit after the filter dryer maintenance.

19. A system for a user to change a filter dryer of a refrigerant recovery unit, comprising:

means for determining whether to replace the filter dryer;

means for generating an alert to change the filter dryer;

means for deactivating the refrigerant recovery unit;

means for preparing the filter dryer to be removed;

means for determining whether the filter dryer has been removed within a preset time; and means for activating the refrigerant recovery machine in response to a second filter dryer being inserted.

20. The system of claim 19, further comprising:

means for generating an alert to change the filter dryer if the filter dryer is not removed within the preset time;

means for determining a vacuum level during the preset time;

means for allowing the user to continue if the vacuum level is less than a predetermined vacuum level; and means for preparing the second filter dryer to be used.

* * * * *